US008347870B1

(12) United States Patent
Mahutga

(10) Patent No.: US 8,347,870 B1
(45) Date of Patent: Jan. 8, 2013

(54) ARCHERY BOW STABILIZER

(76) Inventor: Cory J. Mahutga, Galesville, WI (US)

( * ) Notice: Subject to any disclaimer, the term of this patent is extended or adjusted under 35 U.S.C. 154(b) by 260 days.

(21) Appl. No.: 12/798,931

(22) Filed: Apr. 14, 2010

Related U.S. Application Data

(60) Provisional application No. 61/279,441, filed on Oct. 20, 2009.

(51) Int. Cl.
*F41B 5/20* (2006.01)

(52) U.S. Cl. ..... 124/89

(58) Field of Classification Search ..... 124/86, 124/88, 89
See application file for complete search history.

(56) References Cited

U.S. PATENT DOCUMENTS 3,196,860 A 7/1965 Hoyt, Jr.
3,502,062 A * 3/1970 Shurts ..... 124/23.1
3,752,142 A 8/1973 Morita et al.
4,054,121 A 10/1977 Hoyt, Jr.
4,836,177 A * 6/1989 Williams ..... 124/89
5,090,396 A 2/1992 Bickel et al.
5,273,022 A 12/1993 Leven
5,517,979 A * 5/1996 Closson ..... 124/86
5,535,731 A 7/1996 Webster
5,611,325 A 3/1997 Kudlacek
5,803,070 A 9/1998 Martin et al.
5,992,403 A 11/1999 Slates
6,431,163 B1 8/2002 Chipman
7,318,430 B2 1/2008 Leven

* cited by examiner

*Primary Examiner* — John Ricci
(74) *Attorney, Agent, or Firm* — M. Paul Hendrickson

(57) ABSTRACT

By mounting a bow stabilizer equipped with a mounting base member for mounting the stabilizer to an archery bow and an adjustable stabilizing block gradationally adjustable along the mounting base member in a transverse relationship to a major axis of the archery bow, a highly effective archery bow stabilizer is provided. The stabilizer is equipped with a stop for maintaining the adjustable stabilizer block at the desired stabilizing position. Mounts for mounting weighted stabilizing rods to the adjustable stabilizing block and at an off-set angular position upon the mounting base member coupled with an attached adjustable wrist sling for anchoring archer's wrist and bow to the bow stabilizer provides a unique and highly effective archery bow stabilizer.

13 Claims, 11 Drawing Sheets

ARCHERY BOW STABILIZER

This application is a non-provisional application of earlier filed provisional application No. 61/279,441, entitled "Archery Bow Stabilizer", filed on behalf of Cory Mahutga on Oct. 20, 2009.

FIELD OF INVENTION

The present invention relates to archery equipment, more particularly to an archery bow stabilizer and its use.

BACKGROUND OF THE INVENTION

Archery accuracy depends upon the stability of a bow when addressing and executing a shot from a shooting position. Three dimensional forces arising in all directions about the bow riser creates an inherent instability. An archer's bow string drawing introduces a host of counteracting forces which in turn creates inherent instability while aiming and shooting at a target. Maintaining a targeting site without any upwardly, downwardly, backwardly, or outwardly movement of the bow throughout target sighting, drawing and releasing of the archery arrow inherently creates in instability. Translational and rotational movements will invariably arise at the instant the release of the arrow occurs. By increasing the bow weight to an objectable overweight, transitional movements to a certain degree have been reportedly alleviated. This, solution however, is impractical because it distracts from the necessary fluid movements required by a proficient archer on the range or in the field.

Conventional archery stabilizers typically comprise weighted rods placed at various orientations. Early stabilizers consisted essentially of long aluminum rods threaded into the risers of the bow and weighted at the opposite rod end. Later versions relied upon carbon fiber composites in conjunction with a vibration absorbing device such as disclosed in U.S. Pat. No. 5,273,022. Numerous other patents (e.g. U.S. Pat. Nos. 5,090,396; 5,611,325 and 6,431,163) rely upon multirod stabilizers.

Most bow stabilizers disclosed by the patents generally rely upon a fixed stabilizing position which may not be readjusted except for revamping the stabilizer to another fixed mount so as to accommodate the changing destabilizing conditions. The adjustability of the stabilizing mass in most conventional stabilizers primarily depends upon the rod length and weighted ends threaded into rod receivers often set at various angular positions. Elbowed and jointed stabilizing rods have also been used in attempts to rectify the age old problem of achieving a more perfect stabilization of an archer's bow.

In U.S. Pat. No. 3,196,860 to E. H. Hoyt Jr. there is disclosed stabilization of a bow by rigidly attaching weighted elements to the bow handle perpendicularly from the longitudinal axis passing through the center of gravity of the bow so as to increase a mass movement of inertia about the longitudinal and transverse axis about the center of gravity of the bow without objectionably increasing the weight of the bow. The Hoyt Jr. patent reports that properly positioned weighted elements about the bow handle reduces angular movement of the bow as well as translational movements when releasing the arrow or by flinching. This reportedly alleviates target misalignment due to counteracting forces arising from a drawn bow.

In U.S. Pat. No. 3,752,142, stabilizers are mounted at opposite sides or on the rear face of the bow so as to extend rearwardly on opposite sides of the bow string so as to counterbalance any forwardly extending destabilization. Universal joints are employed to vary the leveling angle of rearwardly extending stabilizers in U.S. Pat. No. 4,054,121.

A recent patent to W. L. Leven (U.S. Pat. No. 7,318,430 B2) discloses a multirod stabilizer. The stabilizer is equipped with shock absorbers to absorb shock arising from bow string and arrow release. The Leven stabilizer is disclosed as having two flexible rods housed within the proximate housing, an intermediate housing and an end housing of a plastic construction provided with compressed resilient sleeves and a shock absorber. The Leven stabilizing device reportedly dampens and absorbs vibrational energy created during the archery shooting of an arrow.

U.S. Pat. No. 5,535,731 to Webster discloses a bow stabilizer consisting of a stabilizing mount for attachment onto a standard stabilizer fitting of the archery bow. The mount fits cross-wise onto the bow handle and includes four stabilizing arms extending downwardly and outwardly in opposing quadrants. In U.S. Pat. No. 5,803,070 to Martin, there is disclosed a stabilizer mount which is vertically incorporated into the bow handle to which threaded receivers or a locking slot are provided for adjustably retaining a threaded bolt at a desired longitudinal stabilizing position.

Variations in angular disposition of the stabilizers have also reportedly been accomplished by pivotal mounting of a stabilizing unit to allow for a stabilizing distribution of weight about the bow handle. An adjustable stabilizer for adjusting along two different planes relative to the bow has been disclosed in U.S. Pat. No. 5,992,403 to Slates. The Slates stabilizer consists of an arm pivotally mounted at one end to the bow's mounting screw and an adjustable stabilizing rod holder at an opposite arm end. By pivoting the stabilizing arm to the appropriate angular position coupled with adjusting the slideable rod within the arm holder to the correct position, the desired stabilizing position is reportedly accomplished.

SUMMARY OF THE INVENTION

The bow stabilizing device of this invention includes a base member mounted or mountable onto a bow riser and an adjustable stabilizing block section adjustable in a transverse relationship to the major axis of the archery bow. The adjustable bow stabilizer herein may be readily adjusted to counterbalance any unbalanced bow weight distribution and other concomitant adverse counterbalancing forces which normally arises while executing an archery shot. The adjustability feature of the bow stabilizer provides a more accurately balanced archery bow which optimizes arrow targeting and release. The adjustable bow stabilizer herein accommodates both right and left handed archers while also allowing for placement of the stabilizer at a finite counterbalancing location so as to effectively counterbalance any unbalanced bow side weight distribution arising by reason of rests, sights, quiver brackets and other attached bow accessories. The finite adjustability feature of the unique bow stabilizer herein effectively reduces destabilization, recoil and hand torque about the bow handle when targeting a shot. The stabilizing device substantially reduces archery hand fatigue which in turn significantly enhances shooting accuracy and the archer's endurance especially under the most demanding archery shooting conditions.

The bow stabilizer may be provided as a separate bow stabilizing attachment or accessory for mounting onto the riser of an archery bow. Alternatively, the bow stabilizer may be directly incorporated into the archery bow riser at the manufacturing site. When the bow stabilizer is directly prefabricated as a integral part of the bow riser, the need for a mount for mounting the bow stabilizer to the bow riser may be eliminated. Accordingly, the mounting base member of the stabilizer may be directly casted, machined or welded onto the riser at the archery manufacturing site.

The present adjustable bow stabilizer herein includes a base member which transversely mounts onto the archery riser. The infield mounting of the stabilizing device to the bow when provided in the form of a stabilizing attachment or accessory may utilize locking slots or the threaded frontal bolt receiver as customarily provided in bow handles or risers for stabilizers and other bow accessories. The stabilizer includes an adjustable stabilizing block section slideably mounted onto the base member for gradationally shifting distribution of bow weight to an optimized center gravity and counteracting bow destabilization. The adjustable stabilizing block section utilizes a stopping member for stopping and maintaining the adjustable stabilizing block section at a desired stabilizing position. A forwardly positioned stabilizing mount for mounting a forwardly projecting stabilizer onto the adjustable stabilizing block significantly contributes to the counterbalancing of any imbalances in weight distribution while the minute adjustability features of the devise serves to counteract the dynamic forces generally created by drawing and releasing an archery arrow.

The base member may be appropriately equipped with a slide engaging section to slideably receive and engage onto a mating sliding unit affixed or integrated into the adjustable stabilizing block section construction. Since the adjustable stabilizing block may be finitely adjusted along the entire transverse length of the slide engaging section, the unique adjustable stabilizing block may accordingly be finitely adjusted along a finite number of positions as it transverses along the slide engaging section. This effectuates a more precise and accurate adjustment of the stabilizing block to reflect a more true and accurate stabilizing position for optimizing bow positioning and arrow targeting efficacy. Should a subsequent corrective measure be desired, such as by changing archery conditions, the readily accessible finite adjustability feature of the stabilizing block section offers an expeditious and accurate mechanism for realignment of the stabilizer to a recalibrated optimized stabilizing position. The unique stabilizer may appropriately utilize an adjustable stopping member which maintains the stabilizer at any desired stabilizing position while permitting an expeditious resetting if necessary.

The adjustable bow stabilizer may be further equipped with an adjustable wrist sling or wrist brace anchored onto the base member which stabilizes the archer's wrist as well as the bow at the targeting position. The wrist sling may be anchored or affixed to the base member suitably equipped with a sling mount and a sling stop for adjustably arresting the wrist sling at a desired wrist size. Sling apertures anchored to the base member may be effectively utilized as sling mounts for receiving and mounting a looped sling about the archer's wrist. An adjustable sling stop maintains the looped sling between the sling apertures, the archers wrist and bow riser at the appropriate wrist sling size and position which serves to integrate the bow and archer into a unified targeting unit. Set screws rounded off at the distal screw end and threaded onto passageways of the sling apertures provide a particular effective adjustable sling stop which allows the looped wrist sling to be conveniently adjusted to any desired wrist sling size and securely anchored onto the base member. The non abrasive contact of the rounded set screw ends against the looped sling permits the sling to be repetitively readjusted without causing any extensive damage, abrasion or fraying of the sling. The adjustability of the wrist sling supported by the base member looped about the bow riser (i.e. bow handle) and the archers wrist firmly anchors the bow, stabilizer and archer's wrist into an integrated and cohesive structure enhancing wrist stability and targeting accuracy of the archer while also significantly reducing wrist and arm fatigue.

More precise and professional alignment to a archery bow targeting and release position may be achieved by equipping the adjustable bow stabilizing device with multidirectional stabilizing mounts for mounting one or more elongated stabilizing extension units such as a rod stabilizers thereto. Accordingly, the base member may be equipped with a plurality of stabilizing rod mounts positioned at divergent or off-set stabilizing rod mounting sites. By positioning the mounting sites at divergent angular positions upon the base member coupled with the unique precision provided by the adjustable stabilizing block, an archer may accurately and precisely position the bow stabilizing device so as to provide the most effective stabilizing combination to achieve an optimum archery efficacy and targeting results.

DETAILED DESCRIPTION OF THE INVENTION

Figure 1:
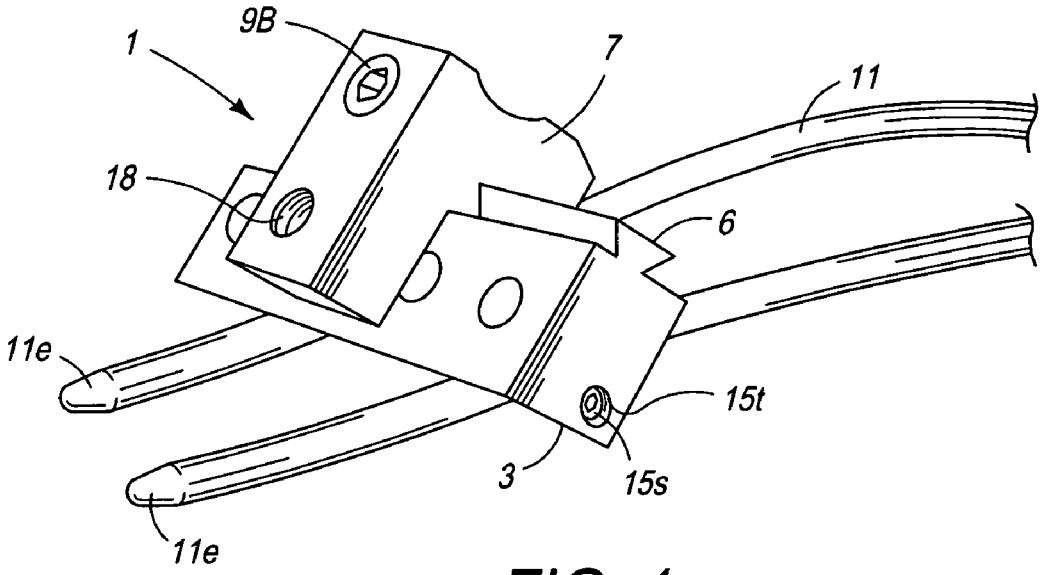
FIG. 1 is an elevational view of an assembled adjustable bow stabilizing device of this invention having a mountable base member with an adjustable stabilizing section slideably mounted thereto.
Figure 2:
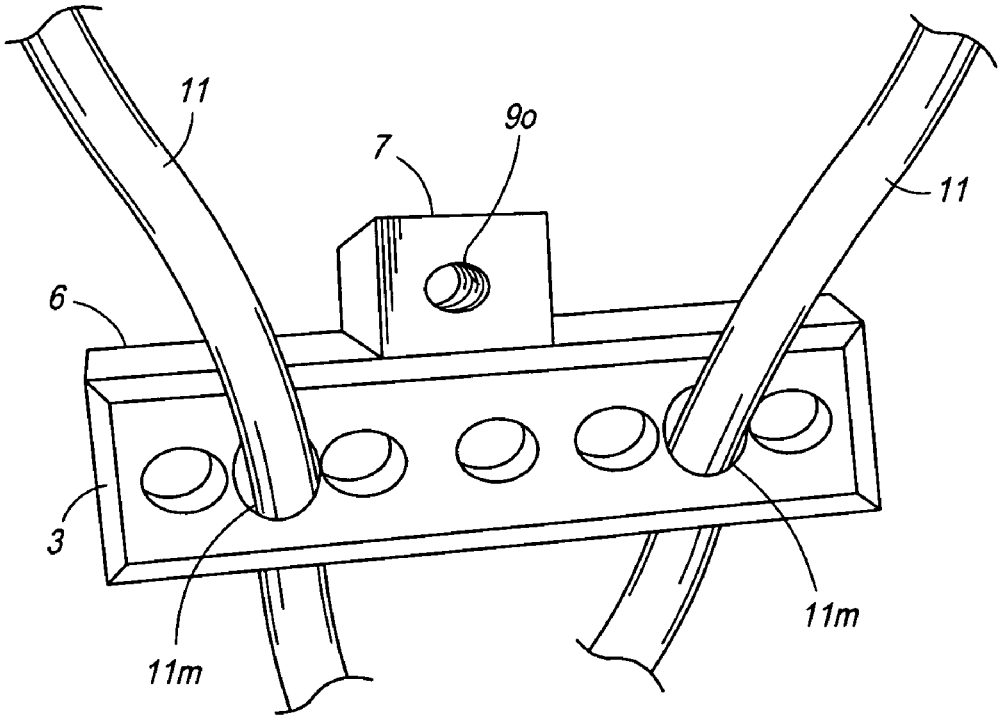
FIG. 2 is a rear view of the assembled device shown in FIG. 1.
Figure 3:
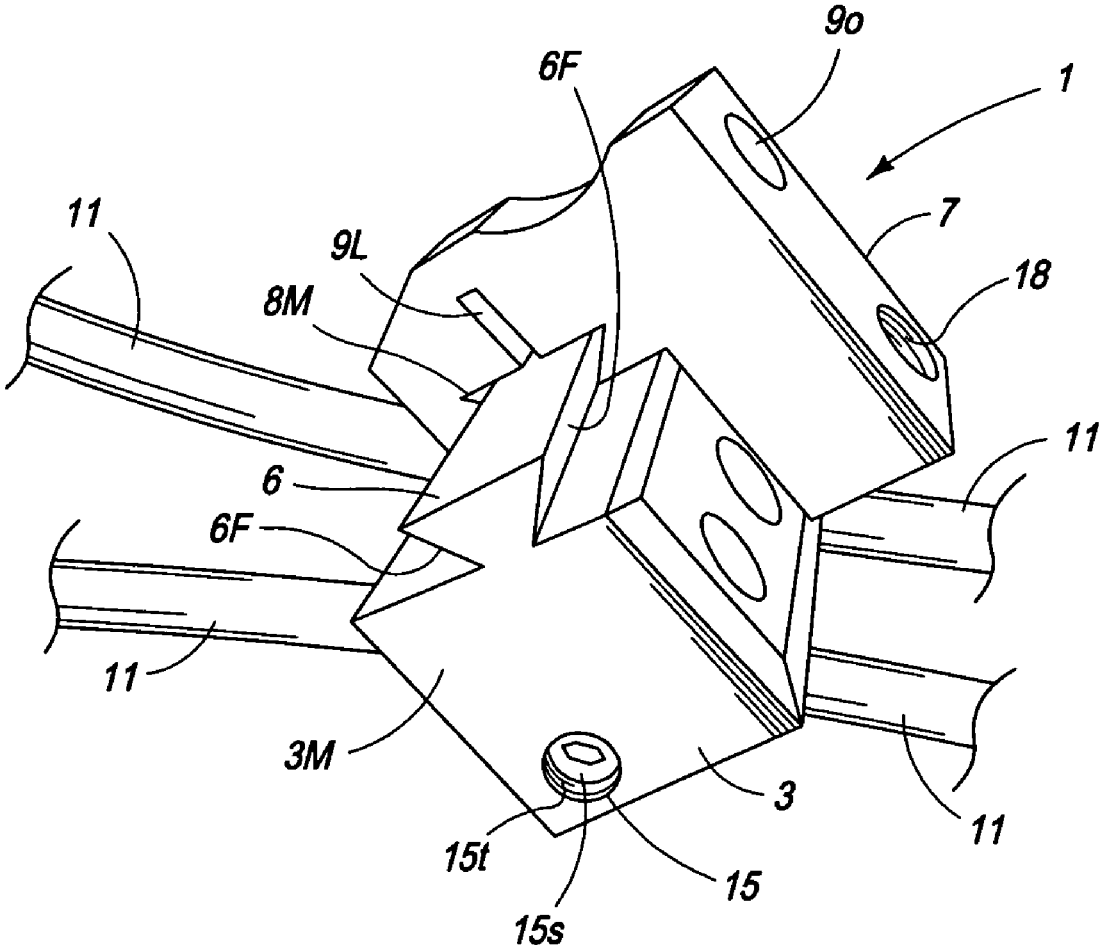
FIG. 3 is a side view of the assembled device shown in FIG. 1.

With reference to the accompanying Figures and the disclosure of applicant's provisional application Ser. No.

61/279,441, there is provided an adjustable bow stabilizing device (generally referenced as 1) for stabilizing an archery bow against weight distribution imbalances and those destabilizing forces inherently arising upon drawing and releasing a targeted arrow. The stabilizing device 1 is mounted onto an archery bow B in a transverse relationship to the longitudinal or major axis of the bow B. The bow stabilizer 1 may be finitely adjusted to a predetermined or optimized center of gravity so as to effectively counterbalance any unequalized bow weight imbalances typically arising from mounted bow accessories while also mitigating against inherent destabilizing forces created or generated from archery use, especially those arising in targeting and releasing a drawn arrow. The present device 1 provides a more accurately balanced and stabilized archery bow B for the archery targeting and arrow release. The adjustable bow stabilizer 1 equally accommodates both right and left handed archers. The slideable highly refined and accurately adjustable stabilizing device 1 features a slideably mounted stabilizing block section 7 which traverses along an axis transverse to the normal archery bow B longitudinal shooting position. This adjustable feature allows the archer to make a minute and gradient placement of the stabilizer 1 at the most effective and finite location so as to effectively counterbalance any opposing bow forces or detrimental bow weight distributions (e.g. such as often caused by attached bow accessories such as rests, sights, quiver brackets and the like). The finite adjustability feature of the unique bow stabilizer 1 reduces hand torque, recoil, and other transitional or destabilizing forces which traditionally torque about the bow riser BW. The device 1 effectively reduces archery hand fatigue which in turn significantly contributes towards greater shooting accuracy, endurance and targeting performance especially under the most demanding and stressful archery shooting conditions.

The present adjustable bow stabilizer 1 may be mounted or provided in the form of a mountable base member 3 which may be directly incorporated or manufactured into the bow riser BW at the bow manufacturing site or it may be provided as an accessory equipped with a bow mounting member 5 for mounting the base member 3 of the bow stabilizer 1 to the bow riser BW in a transverse relationship to the major axis of the archer bow B. The archery bow riser BW may be conventionally equipped with one or more locking slots or the more commonly threaded bolt receiving ports for mounting stabilizers or other bow accessories to the bow B. The mounting member 5 may be accordingly adapted to accommodate a threaded bolt 5B, a locking slot or any other suitable means for mounting the base member 3 to the bow B.

The bow stabilizing device 1 includes an adjustable stabilizing block section 7 which slideably engages onto the base member 3. The adjustable block section 7 provides an effective means for gradationally shifting the weight distribution along an axis transverse the major or longitudinal bow axis so as to create an optimized center of gravity for the archer. When the adjustable stabilizing block section 7 is combined with a forwardly projecting element 17 (e.g. stabilizing unit such as a stabilizing rod) and the base member 3 is additionally equipped with one or more angularly offset stabilizers 19 for mounting off-set stabilizing units 19 thereto, optimum bow stabilization efficacy may be effectuated by the precise and minute adjustability features of the adjustable block section 7. A stabilizing block section stopping member 9 allows for stopping and setting the adjustable stabilizing block section 7 at a desired counterbalancing and bow stabilizing position.

The base member 3 may be appropriately equipped with any suitable slide engaging member 6 which slideably receives and engages onto a correspondingly mating block section sliding unit 8 carried by the adjustable sliding block section 7. Since the adjustable stabilizing sliding block section 7 may be minutely and gradiently adjusted along the entire transverse length of the slide engaging member 6, the sliding stabilizing block section 7 may accordingly be adjusted to a finite or minute stabilizing position along the entire transverse length of the slide engaging member 6 so as to effectuate a more precise and accurate stabilizing adjustment of the sliding stabilizing block section 7 and the stabilizing device 1. This, in turn, reflects in a more true and accurate stabilizing posture for the overall operational use of an archer's bow B by the archer. If subsequent corrective measures may be required (such as arising by changing archery conditions or accessories), the minute re-adjustability features of the stabilizing device 1 allows for an expeditious and accurate resetting of the sliding stabilizing block section 7 to any desired optimized and recalibrated stabilization position.

FIGS. 1-17 illustrate a slide engaging member 6 supported by the base member 3 which slideably engages onto a corresponding mating slide engaging unit 8 carried by the sliding block section 7, either of which mating constructions may be matingly interchanged. The Figures illustratively depict an aperture dovetailed shaped slide engaging member 6 (e.g. see in particular FIGS. 1, 3-4, 7-8 and 13-16) which slideably engages onto a mating trapezoidal shaped or mortise housing or cavity of the mating slide unit 8 (e.g. see FIGS. 3-4, 8, 10, and 14) integrated into the construction of the stabilizing block section 7. Although the mating trapezoidal or dovetailing shaped slide system 8 as depicted by the Figures provides an effective sliding and stopping arrangement for the bow stabilizing device 1 of this invention, a host of other mating channeled and track systems or tracking means (i.e. slideable combinations of 6 & 8) may also be adapted to house or track the adjustable stabilizing section 7. Thus, any slideable tracking means or member 8 which permits the mounting block 3 to slideably engage and retain the adjustable stabilizing section 7 along a slide engaging track 8 at a desired stabilized or stop position so as to permit for an adjustable transverse tracking relationship to the major axis of the bow B may be adopted to the adjustable bow stabilizer 1 herein. For example, the slideable tracking means 8 and stop system 9 may be electronically controlled or rely upon a magnetic slide system 8 with built-in stops 9 or any other system which permits for movement and setting (securing) of the stabilizing block section 7 along a transverse axis to the major bow axis at a desired stabilizing position. Accordingly, the adjustable sliding block section 7 and the mountable base member 3 may be operatively slideably engaged by any sliding mechanism which permits the sliding block section 7 to slideably engage onto the base member 3. Whatever sliding arrangement and stop system 9 is used, it is necessary for the sliding block section 7 to be slideably and gradiently adjusted along a transverse axis relative to the major axis of the bow B and to be stopped and securely set at a desired stabilizing position.

Since the archery stabilizing device 1 of this invention gradationally permits for a minute relative adjustment of the stabilizing block section 7 via the gradient adjustability of the mating slide unit 8 along the traversely positioned track 6 supported by what is referred herein as the planar main section 3M or major axis of the base member 3, the block section 7 weight and weight distribution as well as the distance needed to be traversed to accomplish a desired and effective shift in an archery bow center of gravity as well as overcoming those counterproductive forces creating bow instability may be relatively compact in design. The slideable block section 7 provides a surprisingly compact and highly effective system comparative to those achieved by conventional bow stabilizers. Effective bow stabilization against the deleterious forces generated by the targeting and the release of the targeted arrow when combined with the other stabilizing features of the device 1 may be effectuated by the stabilizing shift of the stabilizing section 7 of 5 mm or less.

The stabilizing effect of the stabilizing block 7 is dependent upon its weight (including its weight distribution) and the off-set or the transverse distance the stabilizing block section 7 traverses. The stabilizing block section 7 need not be of a uniform weight however one of a uniform weight distribution is generally easier to manufacture. In general, a heavier stabilizing block 7 without any off-set stabilizers 21 will have a greater stabilizing effect than a lighter one of equal length. The stabilizing block 7 as well as the base member 3 may be constructed from a variety of materials fabricated by a variety of manufacturing techniques. The base member 3 and the stabilizing block section 7 may be of a molded of a casted or a machined structure fabricated from any appropriate plastic, composite or metal stock material. A particularly suitable material for fabricating the stabilizing block 7 and the base member 3 consists of a machined aluminum 60-61 aircraft grade stock which may easily be machined into the base member 3 and the slideably adjustable block section 7 to provide excellent slide, calibration, a compression biased stop member 9 as well as the appropriate weight and weight distribution for the stabilizing device 1.

The base member 3 provides the transverse tracking distance upon which the stabilizing block section 7 may be slideably adjusted to achieve an optimized stabilizing effect. Because minor shifts in the stabilizing block 7, the base member 3 need not be of an excessively long length. A base member 3 capable of providing about 1 cm to about 2 cm movement of the block section 7 on either side of the major longitudinal axis of the bow (depending upon whether right or from left handed archer and weight distribution) will generally provide sufficient transverse movement for most operational conditions. Lengthier base members 3 may be applied but generally become more bulky and cumbersome so as to limit the desired maneuverability and performance within the field. Shorter base member 3 length (e.g. about 0.5 cm) with heavier stabilizing blocks 7 may be used but are generally less desirable since gradient sensitivity becomes too sensitive and more difficult to finitely adjust to the optimum stabilizing position. If desired, the base member 3 may be adapted to cover only one bow side which may also be accomplished such as by mounting a mirror image base member 3 upon one side or by repositioning or rotating the base member 3 about the mount 5.

A stabilizing block section stopping member (generally referenced as 9) serves to set the adjustable sliding block section 7 at a desired stabilizing position. Any stopping mechanism for stopping member 9 which sets and maintains the sliding block section 7 at a predetermined stabilizing position may be used for this purpose. With reference to the Figures (e.g. see FIGS. 1-4, 8, 10 and 14-16), the adjustable stabilizing block 7 may be suitably provided with a stabilizing block section stopping member 9S depicted as being comprised of an alien wrench headed bolt 9B seated within block section bore 90 which threads onto a threaded stop bore section 9*t* (the threads of which may be threaded within that portion of the stabilizing block section 7 distal from the threaded alien bolt head 9B as shown or alternatively entirely through the stabilizing block section 7) and a compression slot 9L. The compression slot 9L perpendicularly bisects a recessed margin 8M (situated between unthreaded stop bolt bore 9*u* and stop threads 9*t*) immediately above the shoulder region of slide engaging member 6 of base member 3. The recessed margin 8M serves to contribute towards the ease of slideability of the block section 7 when stop bolt 9B is untightened. FIGS. 3-4, 8 and 14 depict compression slot 9L as bisecting the terminating flanged sections 6F of the mating slide engaging member 6 through which allen headed bolt stop 9B is traversely threaded onto a threaded portion 9*t* of the sliding block section 7 distal from bolt head 9B and slot 9L. When threaded bolt 9B is tightened within the adjustable sliding block 7, the compression slot 9L biases or compresses the sliding groove 8 of sliding block section 7 firmly against the slide engaging member 6 which in turn serves to stop and set the adjustable sliding stabilizer 7 onto the base member 3 at the desired stabilizing position. When it is desired to reposition the stabilizing block section 7, the allen wrench headed bolt 9B is simply unthreaded sufficient to disengage stop 9 and then retightened when repositioned at the desired reset stabilizing position.

Figure 4:
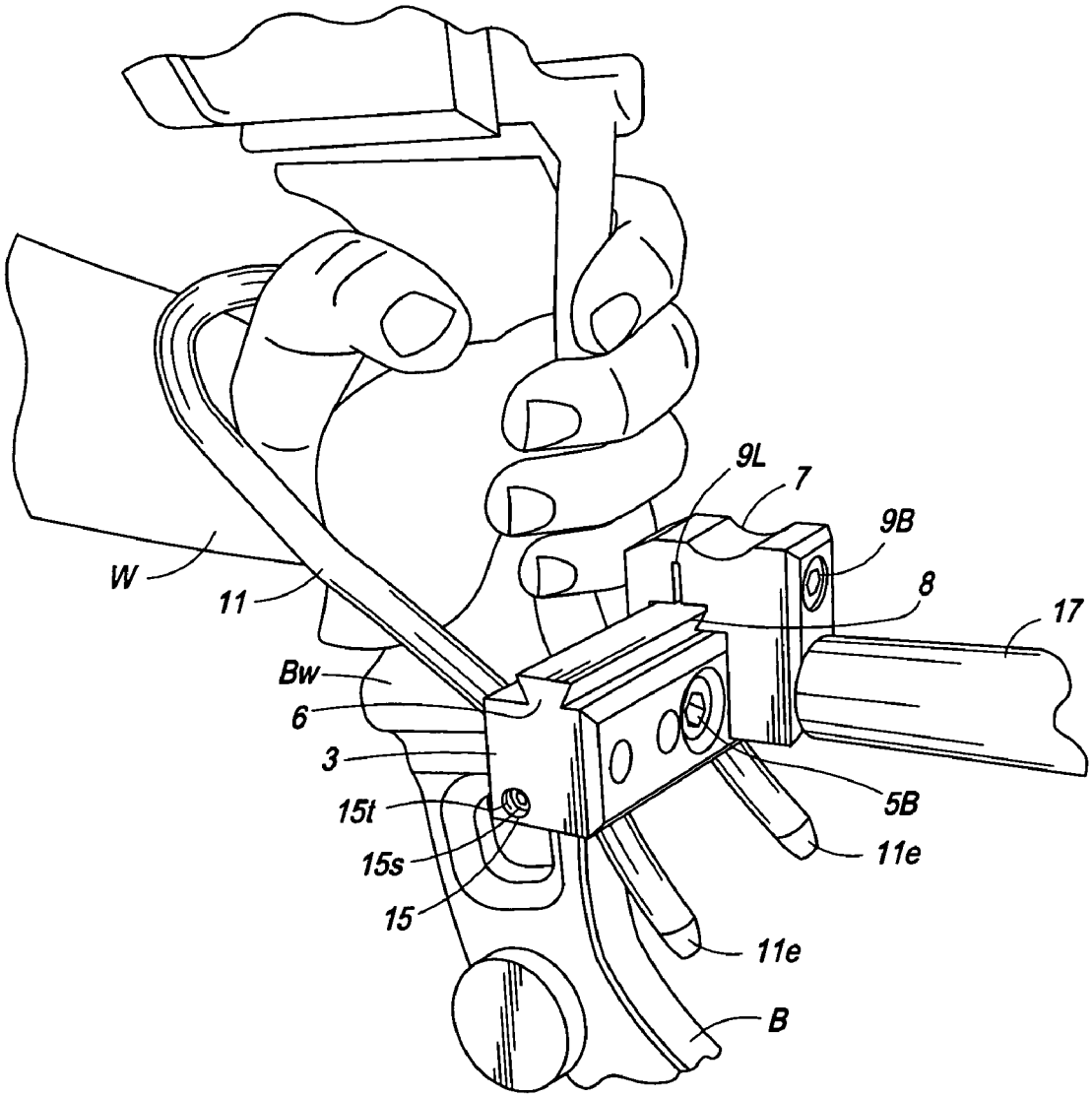
FIG. 4 is an opposite side view of the device shown in FIG. 1 mounted to a bow riser of an archery bow with the depicted wrist sling shown in FIG. 1 being secured to an archer's aiming wrist and slung around the bow riser and a partial view of a stabilizing rod mounted onto the adjustable stabilizing section.
Figure 5:
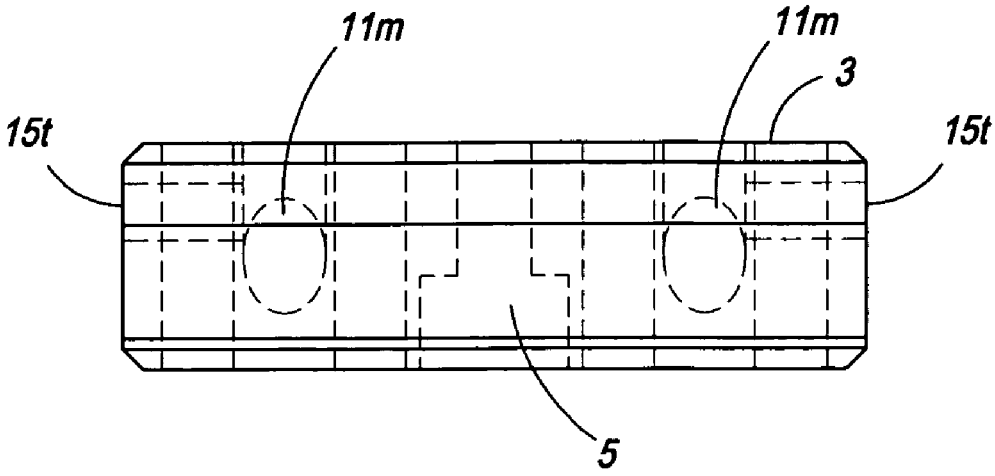
FIG. 5 is a top view of a mountable base member of assembled device shown in FIG. 1.
Figure 6:
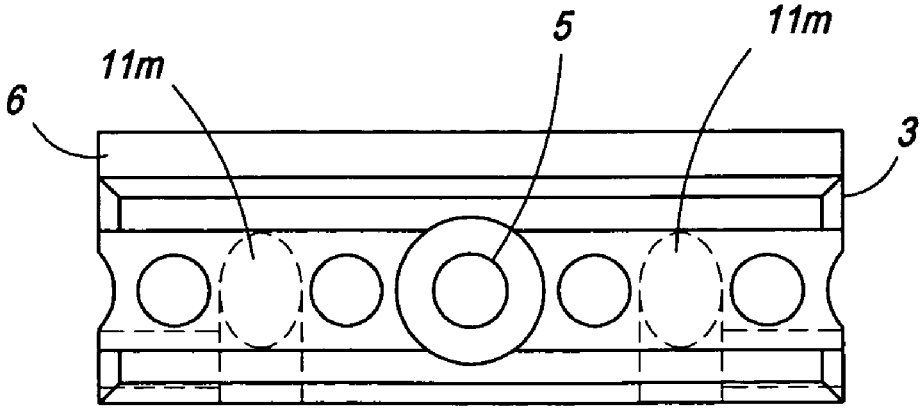
FIG. 6 is a frontal view of the base member shown in FIG. 5.
Figure 7:
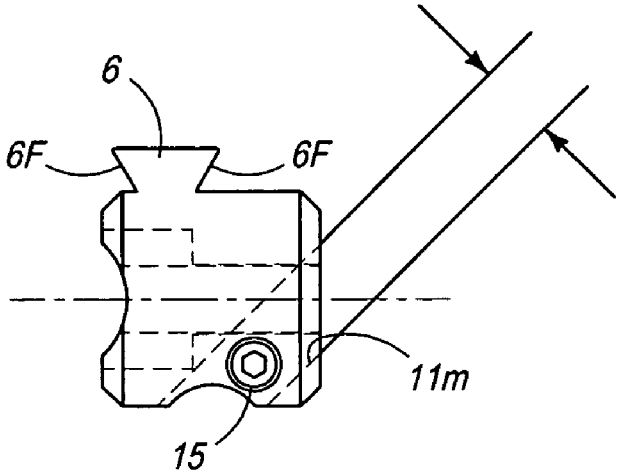
FIG. 7 is an end view of the FIG. 6 base member.
Figure 8:
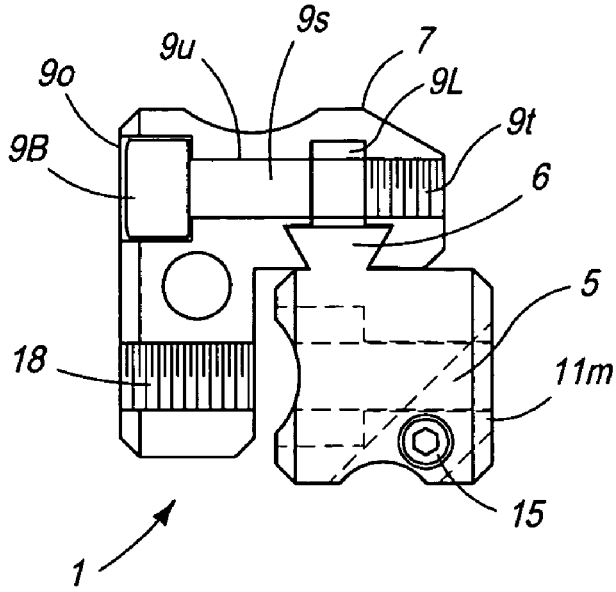
FIG. 8 is an end view of assembled device of FIG. 1 depicting a stabilizing block section slideably mounted onto the base member.
Figure 9:
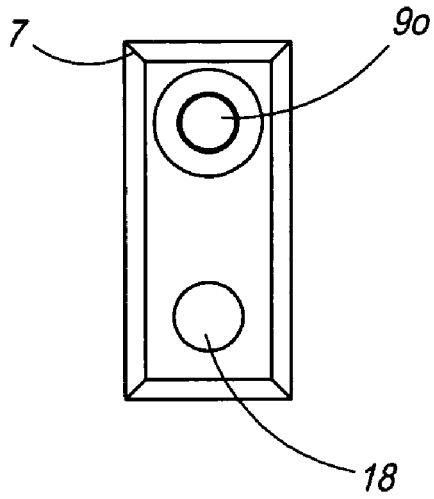
FIG. 9 is a frontal view of the adjustable stabilizing block section.
Figure 10:
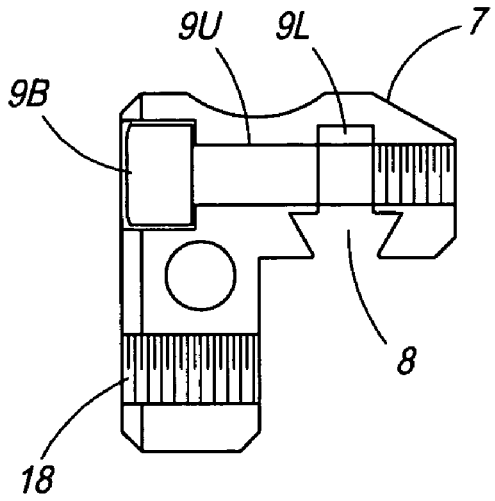
FIG. 10 is a side view of FIG. 9.
Figure 11:
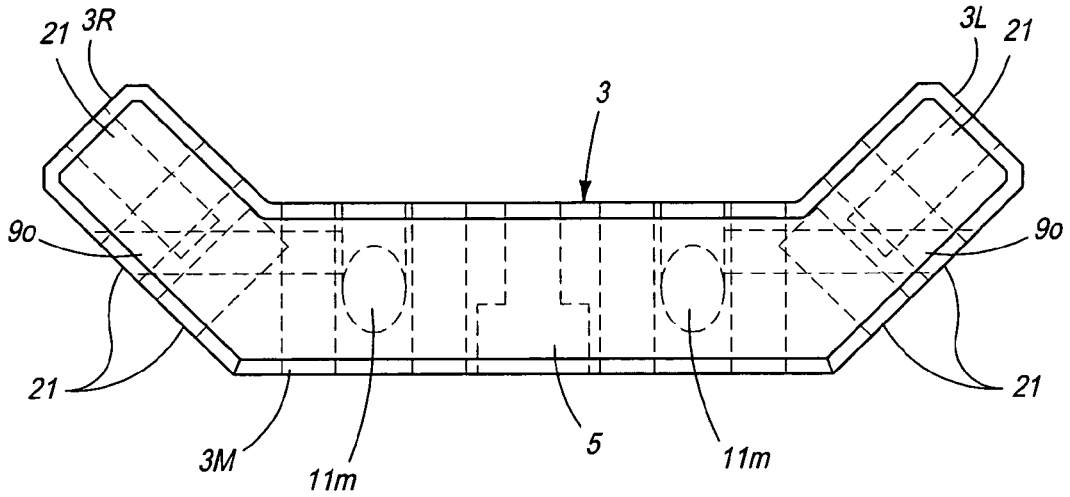
FIG. 11 is a top view of the base member equipped with off-set wing which provides a plurality of off-set stabilizing rod mounts.
Figure 12:
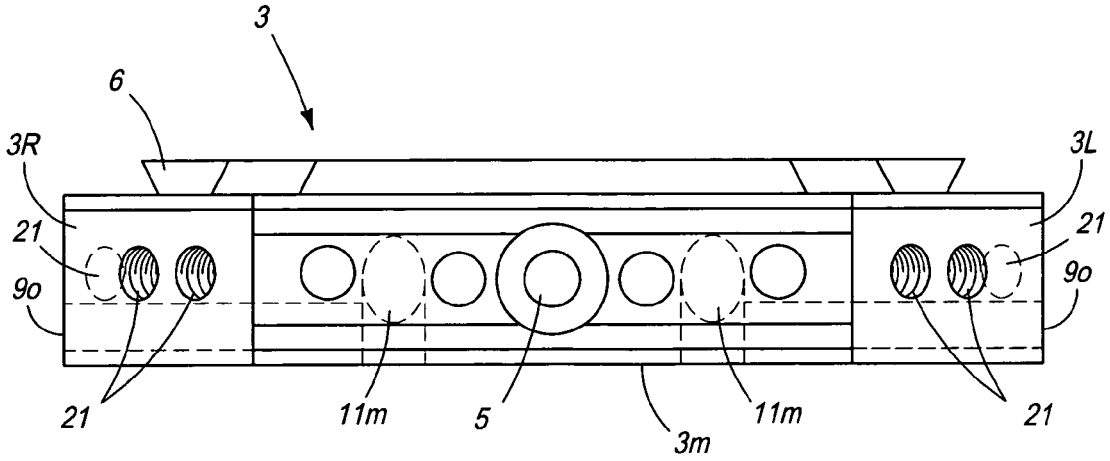
FIG. 12 is a frontal view of FIG. 11.
Figure 13:
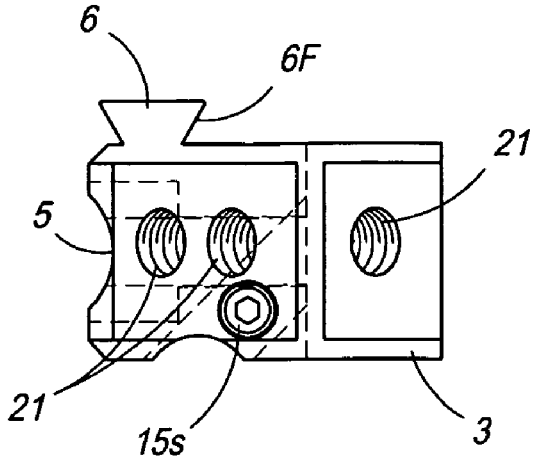
FIG. 13 is an end view of FIG. 12.
Figure 14:
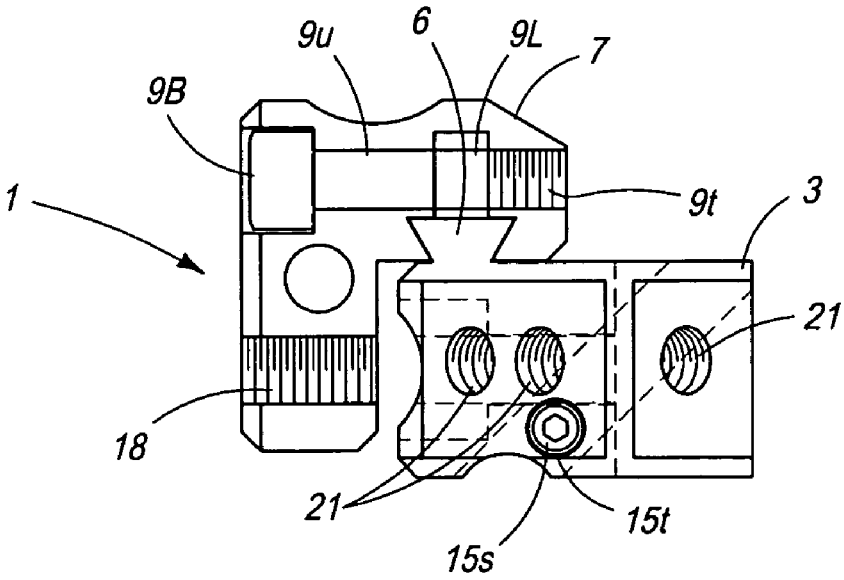
FIG. 14 is an end view of the assembled adjustable bow stabilizing device of this invention equipped with the base member shown in FIG. 13 and the stabilizing block slideably mounted thereto.
Figure 15:
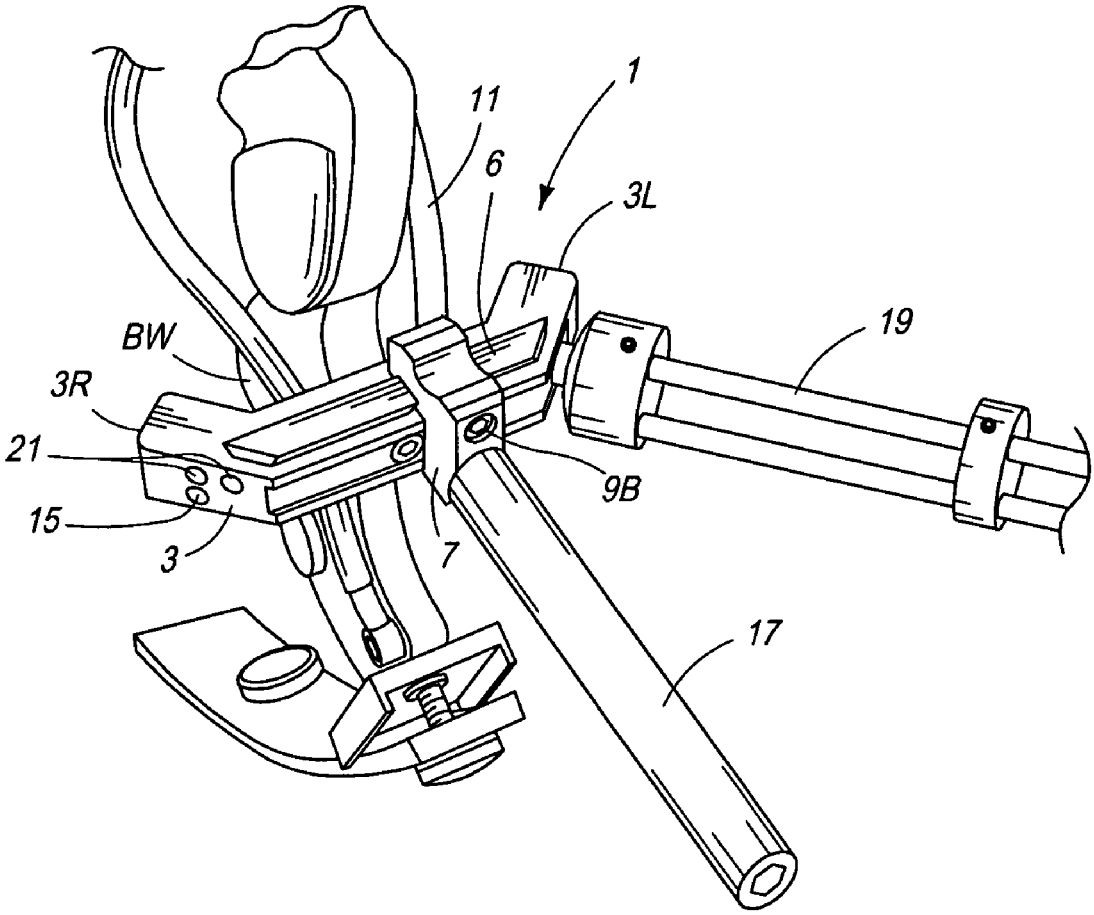
FIG. 15 depicts an elevational front view of the bow stabilizing device shown in FIG. 14 secured onto a bow riser and equipped with an off-set stabilizing rod and a forwardly mounted stabilizing rod.

The adjustable bow stabilizer 1 may be appropriately equipped with an adjustable wrist sling or wrist brace (generally referenced as 11) appropriately carried or anchored onto the base member 3. The wrist sling 11 serves to brace the archer's wrist onto the bow handle BW so as to provide a highly effective integrated targeting unit. The wrist sling 11 may be suitably affixed or adjustably anchored to the base member 3 and equipped with an adjustable sling stop (generally referenced as 15) which allows for adjustment of the wrist sling 11 to a desired wrist size. An effective sling stop 15 may be effectuated by equipping the stabilizing base member 3 with sling apertures 11*m* serving as mounts for receiving a looped wrist sling 11 and a pair of adjustable sling stops 15 which adjust and maintain the looped sling 11 at an appropriate wrist sling position and size such as illustrated by FIGS. 4 and 15. The sling 11 is depicted as being diagonally slung between sling apertures 11*m* communicating from the base or bottom of the base member 3 to the rearward side of base member 3 so as to form a steady and comfortable mount for wrist sling 11. This provides an effective griping of the bow handle by the archer while also placing the wrist sling 11 including the wrist sling ends 11*e* out of the archers' line of sight. The base member 3 is further depicted as being equipped with threaded sling set screw ports 15*t* communicating onto the sling apertures 11*m* which allows for the setting of the wrist sling 11 at any appropriate wrist size (e.g. see FIG. 3 and the phantom lined sling apertures 11M of FIGS. 5-8 and 12). When threaded alien wrench stop screw 15*s* equipped with a rounded thread end (occluded from view) is threaded tightly onto the sling 11 housed within sling aperture 11*m*, the sling section 11 becomes securely anchored onto the base member 3 by wedging the sling 11 tightly against the housing walls of the sling apertures 11*m*. The nonabrasive contact of the wrist sling 11 by the rounded ends of stop set screw 15*s* permits the sling 11 to be repetitively readjusted without any fraying or damage to the sling 11. The variably adjustable wrist sling 11 enhances wrist stability and overall targeting accuracy while also significantly reducing wrist and arm fatigue.

The manner in which the wrist sling 11 may be properly adjusted to a proper wrist size coupled with the integral anchoring of the sling 11 to the mounting base 3 and the archer's wrist onto the bow handle (e.g. see FIG. 4), contributes significantly to an archer's over-all ability to maintain a steady archery posture and aiming positioning upon the targeted site. The wrist sling 11 stabilizes axial movement of the bow B about a stabilizing focal point. These wrist anchoring features coupled with the stabilizing efficacy of the archery stabilizing device 1 contributes towards substantial improvement in overall archery performance.

Other mechanical variations of the sling stop 15 may also be utilized to secure and maintain the wrist sling 11 onto the mountable block member 3. The wrist sling 11 may be fabricated of any comfortable wrist sling material. The depicted sling stop 15 is sized and configured so as to matingly engage and create a stop upon the particular type of sling material used in the sling. Braided rope or other strap slings 11 fabricated from wrist friendly and comfortable material such as braided nylon, rayon, silk, cotton, etc., material may also be used for this purpose. Other types of wrist stops 15 such as plastic strap or rope stops, lock fasteners, etc., may also be adapted to appropriately adjust and maintain the wrist sling 11 at the appropriate wrist sling size.

A properly sized and weighted stabilizing block section 7 as described above may by itself effectuate a substantial redistribution and counterbalancing shift in bow weight and a concomitant shift in the bow center of gravity. The weight distribution shift and effectiveness of the device 1 against inherently present damaging counterforces, however, becomes intensified when combined with the stabilizing block section 7 of the device 1 is equipped with a stabilizing mount 18 and a forward projecting stabilizer 17. Further stabilizing efficacy may be achieved when the base member 3 is equipped with what is referred to as off-set stabilizer mounts 19 for mounting one or more elongated off-set stabilizing units 19 (e.g. off-set stabilizing rods) at a desired off-set stabilizing position upon the base member 3.

As shown in FIGS. 4 and 15-17, a forwardly projecting stabilizing unit 17 (e.g. a stabilizing rod) can be effectively utilized to intensify the appropriate shift in the bow center of gravity. The forwarding projecting stabilizing unit 17 in conjunction with the adjustable features of the sliding block section 7 significantly enhances the overall effectiveness in counterbalancing transitional forces (e.g. torque, recoil forces, etc.) especially which inherently arise during the bow drawings, arrow release, etc. The ability to slideable set and maintain the sliding block 7 with the attached forwardly projecting stabilizing rod 17 at a finite position optimizes the counterbalancing of those forces exerted by bow string activity and significantly contributes to the archer's ability to sight and more accurately release a drawn arrow onto the targeted site. As recognized by archers, the stabilizing rod 17 mounted to the sliding block section 7 should be of sufficient length, size and weight in combination with its adjusted position to provide a desired stabilizing weight distribution and to stabilize the bow B for targeting such as in 3-D shooting, competition shooting, etc., FIGS. 4, and 15-17 show a stabilizer 1 in which the sliding block section 7 is adapted to mount a single forwardly projecting stabilizing rod 17 threaded onto a sliding block section 7 which is further depicted as having a forward face equipped with a threaded rod receiving port 18. The forwardly projecting stabilizing rod 17 mounted to the block section 7 is shown in FIGS. 4 and 15-17 as being positioned in a perpendicular relationship to the base member 3. As previously indicated, the forwarded projecting stabilizing rod 17 stabilizes the archer bow against transitional forces which arise by drawing the bowstring and releasing the arrow upon the targeted site (e.g. torque, recoil, etc.). The adjustable stabilizing section or rod 17 may be any commercial or custom made stabilizer as customarily used by the archer such as one equipped to slot or thread (e.g. a 5/16-24 male thread stabilizer) of the desired size and weight which effectuates the desired stabilization to the bow.

Within the field of archery, professional archers seek a highly optimized or more perfect archery conditions for bow accuracy and stabilization, often under continually changing archery conditions which may be of little concern to a novice archer. The more sophisticated stabilizing device 1 of this invention as illustrated by FIGS. 11-17 portrays a stabilizing device 1 adapted to counterbalance minute bow weight imbalances as well as effectively overcoming other minute inherent transitional forces of little concern to the novice archer but of particular concern to the professional archer. To accomplish this objective, the base member 3 may be fitted with a plurality of threaded stabilizing unit receivers or mounts 21 for mounting thereto one or more off-set stabilizers 19 at the desired mounting position to enhance the stabilizing efficacy of the bow stabilizing device 1 herein. FIGS. 11-17 depict in greater detail a base member 3 equipped with multi-stabilizing unit mounts 21 for mounting one or more off-set rod stabilizers 19 thereto. The depicted base member 3 is depicted therein as being equipped with multiple off-set stabilizing rod mounting receivers or mounts 19, as well as adjustable wrist sling 11 to be appropriately set at the appropriate wrist sling stop to the desired sling size by looping the sling 11 through the sling apertures 11*m* as depicted in FIG. 4.

The undesirable torque and recoiling forces tend to arise at an off-set relationship to the planar axis established by the forwardly projecting stabilizing rod 17 carried by the adjustable block section 7. The planar main section 3M of the base member 3 (as depicted by FIGS. 1-8) when provided with one or more off-set stabilizing rod mounts 21 for mounting one or more off-set stabilizing rods 19 onto the base member 3 at a torque stabilizing position (e.g. see FIGS. 11-17) provides an extremely highly effective means for overcoming such transitional destabilizing factors. Angular off-setting mounting 21 of the off-set stabilizing rods 19 upon the mountable base member 3 may be accomplished by incorporating into the mountable base member 3 angular positioned mounts 21 such as provided by a pair of angular off-set wings 3L & 3R (as shown in FIGS. 11-17) each of which is fitted with one or more off-set angular mounts 21 for mounting off-set stabilizing rods 19 thereto at a desired torque and transitional force arresting off-set position. The angular off-set wings 3L & 3R are shown in FIGS. 11-17 as resting in a obtuse angular position relative to the main planar axis or planar main section 3M of the mountable base member 3. The off-set winged positioning of the wings 3L & 3R allows for the appropriate placement and mounting thereto of the one or more off-set stabilizing rods 19 thereto. Thus, the winged off-set mounts 21 allow an archer to position the off-set stabilizing units 19 at a predetermined number and off-set stabilizing positions sufficient to have a substantial impact upon the desired stabilization of the bow B. As may be observed from FIGS. 11-17, wings 3L & 3R are depicted as being fitted with off-set rod mounts or orifices 21 which permit the one or more of the off-set stabilizing rods 19 to be positioned at a desired off-set torque counteracting position.

Figure 16:
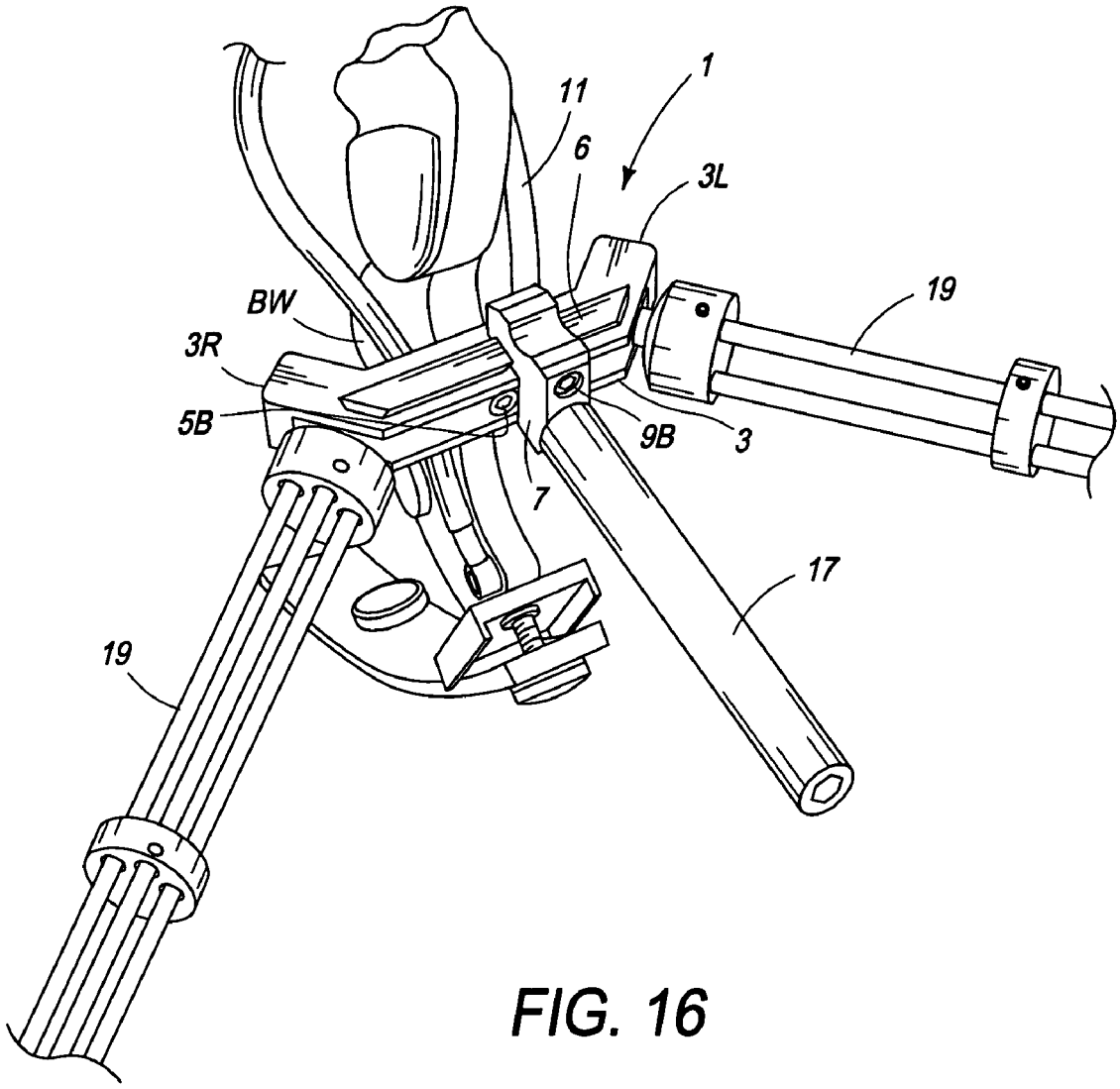
FIG. 16 depicts the stabilizing device shown in FIG. 15 depicting two off-set stabilizing rods mounted thereto.
Figure 17:
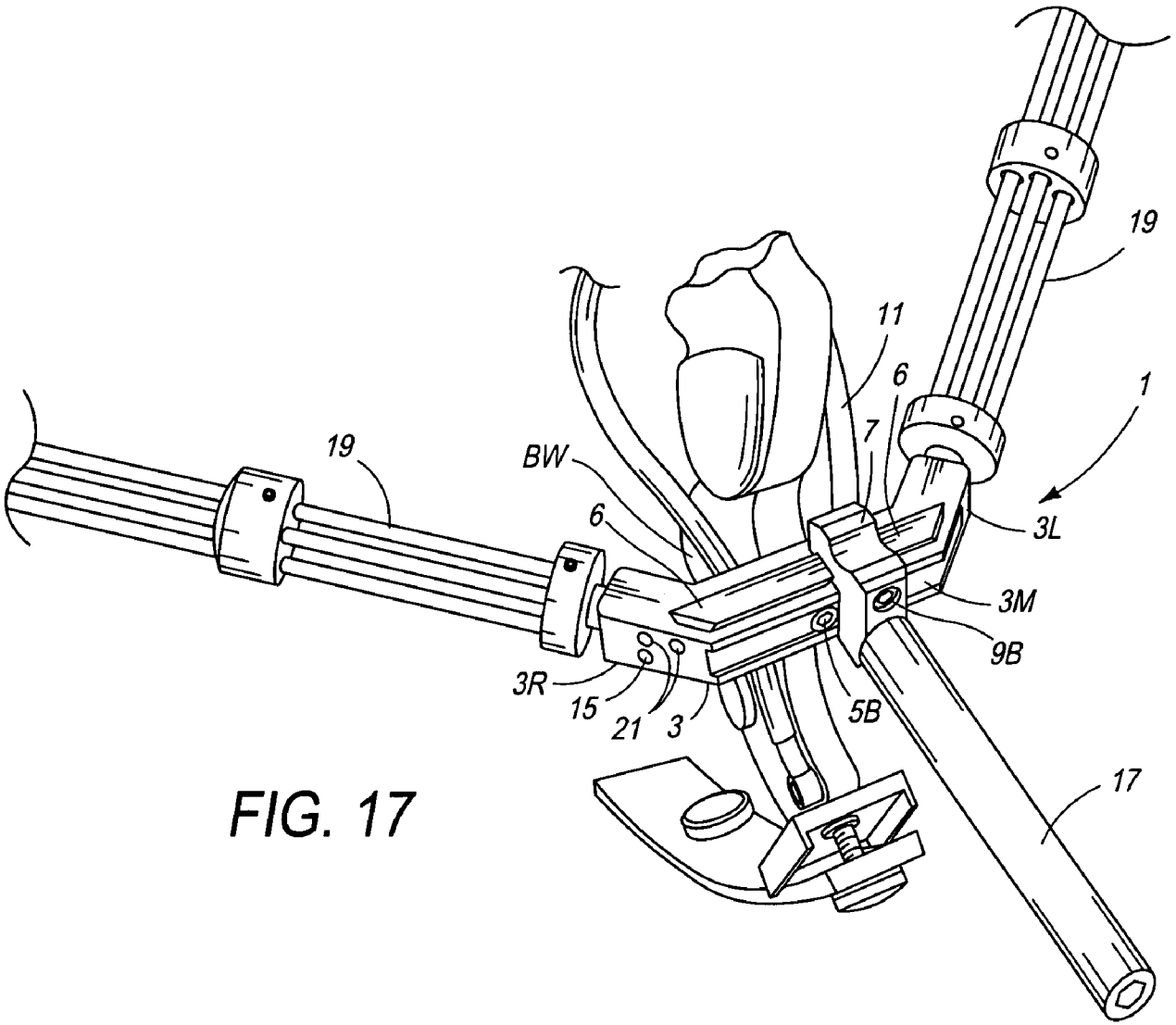
FIG. 17 is an elevational front view of FIG. 15 of the stabilizing device equipped with two rearward projecting off-set stabilizing rods.

FIGS. 11-14 depict wings 3L & 3R without any mounted off-set stabilizing rods 19 while FIG. 15 depicts a single off-set stabilizing rod 19 forwardly positioned at an off-set angular position placed upon the left wing 3L of base member 3 whereas FIG. 16 discloses two forwardly facing and off-set stabilizing rods 19 mounted onto both opposite wings 3R & 3L. FIG. 17 depicts each of wings 3R & 3L equipped with a rearwardly facing off-set stabilizing rod 19. Each of the depicted off-set mounts 21 is capable of accommodating an off-set stabilizing rod 19. The stabilizing rod 19 for the sliding block section 7 and the off-set stabilizer or the offset stabilizers 21 may be custom made or factory made, the selection of which is generally personal to each archer.

The multiple offset rod stabilizing feature provided by base member 3 as depicted in FIGS. 11-17 is shown as being of a winged configuration comprised of a substantially planar main section 3M terminated by pair of rearwardly extending wings 3R & 3L fitted with threaded stabilizing rod receiving orifices or mounts 21 for attaching the desired threaded stabilizing rods 19 thereto at the appropriate stabilizing position. Wings 3L & 3R are each depicted as being provided with three threaded rod receiving orifices 21, one of which is positioned at each distal end and the other two splitting the frontal off-set sections of wings 3L & 3R. This allows for rearwardly positioning of stabilizing rods 19 threaded thereto at each end as well as two forwardly positioned threaded stabilizing rods mounts 21 for mounting the stabilizing rods 19 at a plurality of desired and divergent angular positioning to each wing 3L & 3R. These multi-stabilizing mounts 21 set at off-setting positions upon the mountable base member 3 coupled with the infinite adjustability of the slideable stabilizing block 7 fitted with the forwardly projecting stabilizing rod 17 provides a highly versatile stabilizing device 1 for precisely incorporating those necessary bow stabilization features into the archery bow B for optimized archery bow stabilization efficacy. The base member 3 and the stabilizing block section 7 may be appropriately threaded to receive the standard 5/16 male thread so as to accommodate the most commonly available rod stabilizers 17 & 19.

Variations in angular positioning of the off-set stabilizing rods may be accomplished by off-setting means other than provided by the depicted winged base member 3. For example, the stabilizing rod receivers 21 may drilled or slotted at different angles or by imparting different arcuate or angular structure into the base member 3 or base member main section 3M construction or alternatively by relying upon elbowed stabilizing rods or receivers or any other off-set mounting means 21 for achieving multiple angular positioning of the off-set rod stabilizers 19 at the desired stabilizing position. The bow stabilizing device 1 equipped with the off-set rod stabilizers depicted herein provides a highly accurate and refined bow stabilizing system for professional archers.

The adjustable archery stabilizing device 1 may be effectively utilized to balance an archery bow B against an improper distribution of bow weight and destabilizing force inherently generated while drawing and releasing a targeted arrow therefrom. The device 1 may be used in the field by mounting the adjustable archery stabilizing device 1 to a bow riser of the archery bow B or by prefabricating the stabilizing device onto the archer bow at the manufacturing site. The stabilizing device 1 may be accordingly incorporated or integrated into the bow construction at the bow manufacturing site or provided as a bow attachment which the archer may use an auxiliary bow unit. As previously mentioned, the device when used generally comprises a base member 3 mounted onto said bow riser BW, an adjustable stabilizing block section 7 slideably engaging onto the base member 3 in a transverse relationship to a major axis of the archery bow B so as to permit an adjustment to the block section 7 by the archer to a desired stabilizing position. The stabilizing device 1 may appropriately include a stabilizing rod mounting site 18 for mounting at least outwardly projecting elongated stabilizing element 19 onto the stabilizing device 1, an adjustable wrist sling 11 secured onto the base member 3 for attachment and use onto the aiming wrist W of an archer and a block stopping member 9 for securely stopping the slideably adjustable stabilizing block section 7 at the desired stabilizing position. When used by the archer, the wrist sling 11 is adjusted to a desired wrist size for the archer using the stabilizing device 1 and the adjustable stabilizing block 7 is slideably adjusted along the base member 3 to a desired stabilizing position to stabilize the bow B for targeting and releasing a targeted arrow. The stabilizing feature permits the archer to effectively utilize the bow B to negate the adverse effects of archery destabilization.

As previously mentioned, significantly enhanced performance of the stabilizing device 1 may be achieved by equipping the block section 7 with an elongated stabilizing unit mount 21 for mounting a forwardly projecting elongated stabilizing section (e.g. rod) 19 thereto as illustrated in FIGS. 4 and 15-17. In operational use, the archer typically adjusts the slideably adjusted section 7 to the desired stabilization position and selecting the desired forwardly projecting block section stabilizing unit 17. For most archers, the slideably adjusted stabilizing device 1 depicted by FIGS. 1-10 of this invention will permit the ordinary archer to outperform conventional archery stabilizing devices.

For those archers possessing the highest degree of archery skill (e.g. professionals) the slideably adjustable stabilizing device 1 herein equipped with multiple off-set elongated stabilizer mounts 21 for mounting multiple elongated stabilizing units 19 thereto as illustrated in FIGS. 15-17 provides a stabilizing device 1 providing outstanding efficacy in overcoming those minute destabilizing factors which distinguish professional archers from non-professional archers. This may be most effectively accomplished by equipping the adjustable block section 7 with a block stabilizing rod mount 18 and further equipping the base member 3 with a plurality of off-set rod mounts 21 at varying angular positions along the major axis of the base member 3 and particularly by equipping the base member 3 with a plurality of elongated stabilizer or rod mounts 21 positioned at an off-set angular position from the major axis of the base member. The professional archer equipped with a stabilizing device 1 equipped with a slideably adjustable block section 7 and a plurality of off-set stabilizing rod mounts 21, merely needs to insert a desired quantum of off-set stabilizing rods 19 at a desired rod stabilizing position or positions while adjusting the slideably adjustable sliding section 7 to the desired slide section stabilizing position to effectuate the necessary professional archery stabilizing conditions. As archery conditions change, the archer may accordingly adjust to the desired stabilizing conditions accommodated by the stabilizing device 1 herein to fit those changing archery conditions.

What is claimed is:

1. An adjustable archery bow stabilizing device for stabilizing an archery bow against weight distribution imbalances and destabilizing forces generated while drawing and releasing a targeted arrow therefrom, said device consisting essentially of a base member equipped with a lengthwise slide engaging section securely mountable to the bow in a transverse relationship to a major axis of the archery bow, an adjustable stabilizing block section slideably engaging onto the slide engaging section of the base member, with said block section being adjustable to a desired stopped stabilizing position by traversing lengthwise along the slide engaging section at the transverse relationship to the major axis of the bow, with said block section also being equipped with a stopping member for stopping and securely setting the slideably mounted stabilizing block section along the slide engaging section at the desired stopped stabilizing position and including at least one mounting site for mounting a forwardly positioned elongated stabilizing element to the stabilizing block, and an adjustable wrist sling secured onto the base member for attachment onto an aiming wrist of an archer.

2. The device according to claim 1 wherein the base member includes mounting means for securely mounting the base member to a bow riser of an archery bow.

3. The device according to claim 1 wherein the device is mounted onto a bow raiser of an archery bow.

4. The device according to claim 1 wherein the device includes a forwardly projecting stabilizing rod mounted to the mounting site.

5. The device according to claim 1 wherein the base member includes a plurality of offset elongated stabilizing mounts for mounting elongated stabilizing elements at an offset angular relationship to said adjustable block section.

6. The device according to claim 5 wherein at least one of the off-set elongated stabilizing mounts includes at least one off-set stabilizing rod mounted thereto.

7. The device according to claim 1 wherein the base member comprises a planar main section equipped to slideably engage onto the block section, with the main section including a pair of off-set wing sections positioned at an off-set angular relationship to said main section, with said wings having a plurality of off-set stabilizing mounts equipped for mounting the elongated stabilizing elements thereto.

8. The device according to claim 7 wherein the stabilizing elements comprise at least one stabilizing rod mounted onto at least one winged section of the pair of off-set winged sections.

9. The device according to claim 8 wherein the device is mounted onto the bow riser of an archer's bow.

10. A stabilizing archery bow combination for stabilizing an archery bow against weight distribution imbalances and destabilizing forces generated while drawing and releasing a targeted arrow onto a target site, said combination comprising the archery bow and a bow stabilizing device with said stabilizing device being comprised of a base member equipped with a lengthwise slide engaging track mounted onto a bow riser of the bow in a transverse relationship to a major axis of the archery bow, an adjustable stabilizing block section slideably engaging onto the slide engaging track so as to permit the adjustable stabilizing block section to be adjusted to a desired stopped bow stabilizing position with said block section including at least one block mounting site for mounting a forwardly projecting elongated stabilizing element to the stabilizing block, an adjustable wrist sling secured onto the base member for adjustable attachment onto an aiming wrist of an archer using the combination, a stopping member for stopping and securely setting the adjustable stabilizing block section at the desired stopped stabilizing position and wherein the base member includes a longitudinally extending main section equipped with terminating winged sections equipped with elongated stabilizing element mounts positioned upon said wing sections at an off-set relationship to said main section.

11. The combination according to claim 10 wherein a plurality of stabilizing rods are mounted onto the elongated stabilizing element mounts.

12. A method for stabilizing an archery bow against an improper weight distribution and destabilizing forces inherently generated while targeting and releasing an arrow upon a targeted site with said bow, said method including:

A) mounting an adjustable archery stabilizing device to a bow riser of the archery bow, said device comprising a base member mounted onto said bow riser with said base member being equipped with a slide engaging section tracking lengthwise in a transverse relationship to a major longitudinal axis of the bow when positioned in the shooting position, a plurality of offset mounting sites for mounting off-set stabilizing rods thereto at an off-set angular relationship to the base member, an adjustable stabilizing block section slideably engaging onto the slide engaging section so as to permit a lengthwise tracking and adjustment of the block section at a desired set stabilizing position, with said block section including at least one block mounting site for mounting a forwardly projecting elongated stabilizing element onto the stabilizing block, an adjustable wrist sling secured onto the base member for attachment onto the aiming wrist of an archer and a stopping member for stopping and securely setting the slideably adjustable stabilizing block section at the desired stabilizing position;

B) securing the wrist sling onto the aiming wrist of the archer;

C) mounting the forwardly projecting stabilizing element to the block mounting site and at least one stabilizing rod to the offset mounting sites; and D) slideably adjusting and securely setting the adjustable stabilizing block section to the desired set stabilizing position before releasing the arrow upon the targeted site.

13. The method according to claim 12 which include the additional step of aiming and releasing a drawn arrow upon the targeted site.

* * * * *